US005407365A

United States Patent [19]

Lin

[11] Patent Number: 5,407,365

[45] Date of Patent: Apr. 18, 1995

[54] STRUCTURE FOR A PRINTED CIRCUIT BOARD SLOT CONNECTOR

[76] Inventor: Yu-Chuan Lin, 17,Lane 1, Chung-Hsing Rd., Sec. 1,, Wu-Ku Ksiang, Taipei Hsien, Taiwan, Prov. of China

[21] Appl. No.: 135,822

[22] Filed: Oct. 13, 1993

[51] Int. Cl.[6] ..... H01R 23/70

[52] U.S. Cl. ..... 439/636; 439/633; 439/329

[58] Field of Search ..... 439/633, 79, 62, 65, 439/326–328, 630, 636, 637, 329, 636

[56] References Cited

U.S. PATENT DOCUMENTS

| | | | |
|---|---|---|---|
| 4,996,766 | 3/1991 | Piorunneck et al. | 439/637 |
| 5,041,023 | 8/1991 | Lytle | 439/637 |
| 5,051,099 | 9/1991 | Pickles et al. | 439/636 |

*Primary Examiner*—David L. Pirlot
*Attorney, Agent, or Firm*—Pro-Techtor International

[57] ABSTRACT

A new structure for a printed circuit board slot connector for securing the inserted printed circuit board and provides electrical contacts between the inserted printed circuit board and the mother board. Said connector mainly comprises a plurality of electrical conducting plates which are grouped together in a band. Said band of conducting plates can be installed into the connector from the bottom of the shell body in a single operation. Mechanical operation is used to cut and isolate the conducting plates from one another. The internal contact pins are longer than the external contact pins. Below the point of contact of the conducting plate with the printed circuit board is a projected portion which strengthens the conducting plate. In addition, either one of the three types of securing members is designed in the structure of the connector: at least one printed circuit board securing member is designed in an appropriate location of the internal shell body, said printed circuit board securing member is used to secure the mounting of the printed circuit board, or at least one mother board securing member is installed such that the connector can be securely mounted on the mother board, or at least a dual-usage securing member is installed as the printed circuit board securing member or the mother board securing member.

7 Claims, 12 Drawing Sheets

STRUCTURE FOR A PRINTED CIRCUIT BOARD SLOT CONNECTOR

BACKGROUND OF THE INVENTION a) Field of the Invention

The present invention relates to a new structure for a printed circuit board insertion slot connector. More specifically, the present invention relates to an improved structure of the printed circuit board slot connector which consists of special designed conducting plates, a printed circuit board securing member, a mother board securing member or a dual-usage securing member.

(b) Description of the Prior Art

The demand for a high-density printed circuit board connector is high nowadays and the physical size of the connector is headed to be more compact. To meet these goals the conducting plates of the connector is getting smaller. This creates some problem in securing the printed circuit board and keeping the conducting plates in place. For example, when a printed circuit board is inserted into the slot connector, the conducting plates of the connector is not firm enough to it and can possibly be pushed downward and deformed. Some of the conventional structure of the conducting plates have arc segments design at the insertion point. This creates a high resistance during insertion and wear out the conducting plates quickly. In addition, the conventional internal conducting plates and the external conducting plates have a symmetrical design structure, the printed circuit board holes for the conducting plates are standard, therefore, the plastic base must have a structure that conforms to the symmetrical structure of the internal and the external conducting plates, the limited spaces thereof and the size of the insertion slot. These lead to an uneven thickness of the plastic base, as is shown in the sole drawing of the prior art. Therefore, it takes longer to fabricate the plastic base. The uneven thickness can also cause a shrinkage and rough finish which affect the physical appearance of the base. It is also hard to control the accuracy of the dimension.

In addition, a conventional slot connector structure uses a design to secure the connector to the mother board in a lateral direction. Therefore, when the connector is guided into the mother board, it often shifts in the longitudinal direction. For this reason it is not easy to guide the connector into the mother board. The mounting is usually not secure after positioning due to the back and forth movement in the longitudinal direction. Moreover, the plastic securing post of the plastic base is easy to break and is hard to control its tightness. Keeping the post too tight makes it hard to insert into the guiding hole of the mother board, and keeping it too loose makes the connector unsecured in the mother board. Also, the portion of the connector exposed to the bottom of the mother board must be able to withstand high temperature during wave soldering. Therefore, the overall base of the connector must use special plastic material which can withstand high temperature. This drives up the cost of the connector and is not efficient and economical.

Moreover, a conventional printed circuit board connector uses its contact pins to grip the inserted printed circuit board. Since the contact pins and the edge of the printed circuit board are usually plated with a thin layer of metal such as copper or gold, the repeated removals and insertions of the printed circuit board induce wears and tears of the connector. Therefore, the gripping of the contact pins on the circuit board shall not be too tight. If the gripping force were too tight, the metal layer on the surface of the contact can be scratched off due to the repeated insertion and removal of the printed circuit board. This degrades the quality of the connector. In general, the thickness of the printed circuit board are not standard, and the conventional connector are usually designed to adapt a thicker printed circuit board. Since the contacts are not allowed to grip the inserted circuit board tightly due to the aforesaid reasons, therefore, when a thinner printed circuit board is inserted into the connector, a gap is left on each side of the connector in the longitudinal direction. As a consequence, the inserted circuit board tends to skew to one side of the connector, causing a scratching on the plastic surface and an unbalanced pressure on the contacts on both sides. These lead to a degrading on the gripping and a deformation of the contacts as well as unstable electrical contacts.

SUMMARY OF THE INVENTION

The main object according to the present invention is to provide a new structure for a printed circuit board slot connector in which the upper portion of the conducting plate has a first curved corner located below the inner wall, said curved corner creates a wider slanting space for the printed circuit board to be inserted into the slot with a minimum force, thus eliminating the friction between the contact pins and the edge of the printed circuit board.

Another object according to the present invention is to provide a printed circuit board slot connector in which a second curved corner is designed below the contact point in the conducting plate, said second curved corner pulls the conducting plate to be 5 vertical, also, a projected portion is designed below the contact point of conducting plate so that the conducting plate is strengthen to withstand a higher pressure while the printed circuit board is being inserted.

A further object according to the present invention is to provide a printed circuit board slot connector in which the internal contact pins are longer and the external contact pins are shorter so as to match the holes of the mother board and the size of the connector main body. This configuration gives a more uniform thickness in the plastic main body, increases the production speed and reduces the surface roughness from the shrinkage.

Still another object according to the present invention is to provide a connector in which the conducting plates are grouped in a band and can be inserted from the bottom of the shell body in a single operation.

Still a further object according to the present invention is to provide a connector in which a securing member is used to either secure the inserted printed circuit board, the mother board or both of the boards. Said securing member is used as a supplement to the conducting plate to prevent the printed circuit board from vibrating and may be of one of the three types: the printed circuit board securing member, the mother board securing member or the dual-usage securing member.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
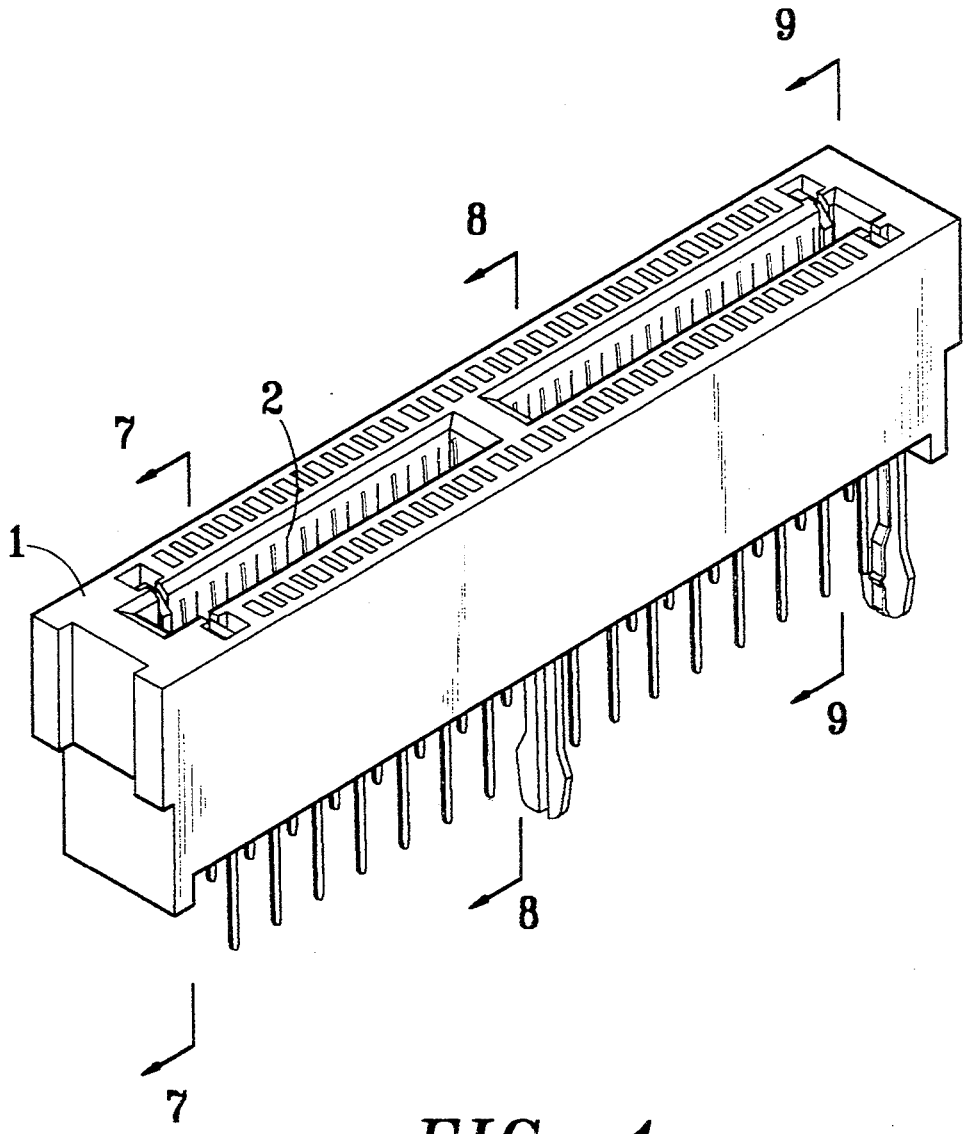
FIG. 1 is a top perspective view of an embodiment of the printed circuit board connector according to the present invention.

An embodiment of the printed circuit board connector according to the present invention is shown in FIG. 1. It mainly consists of an elongated shell body 1 which has two slots 2 for the insertion of two printed circuit boards. The vertical side walls of each of the slots 2 have a row of channels, each of which has a conducting plate 3. The conducting plates 3 extend through the bottom of the shell body 1. When the printed circuit boards are inserted into the slots 2, the edge circuits of the printed circuit board can conduct with the printed circuits of the mother board through the solder contacts of the conducting plates and the printed circuits of the mother board.

Figure 2A:
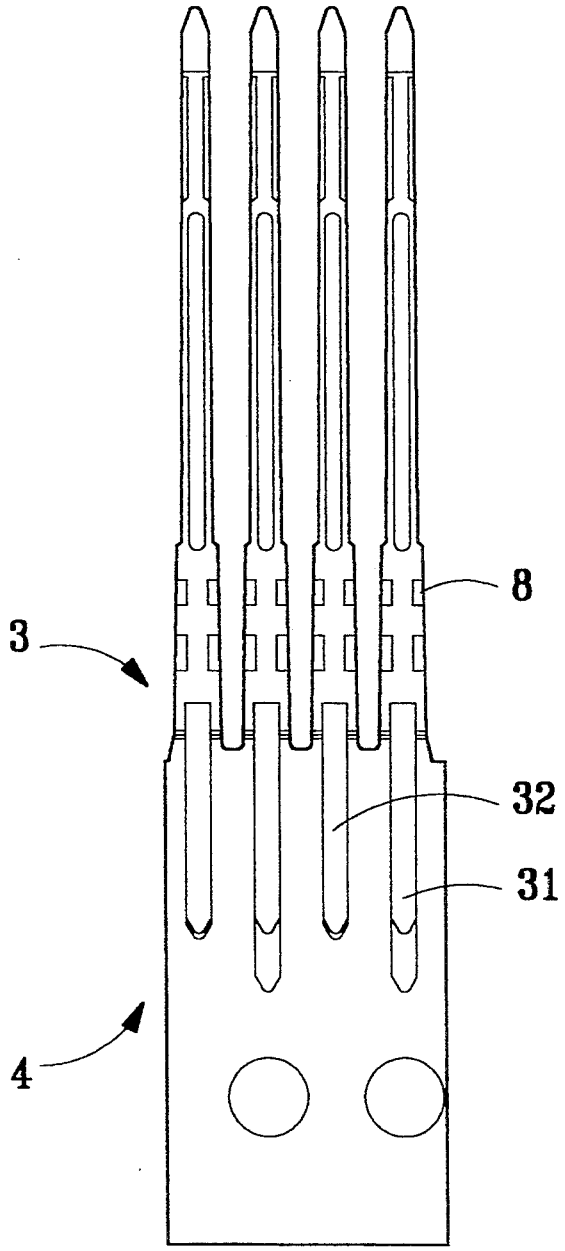
FIGS. 2A–2D are respectively the front view and the side view of a band of the conducting plate according to the present invention.
Figure 2B:
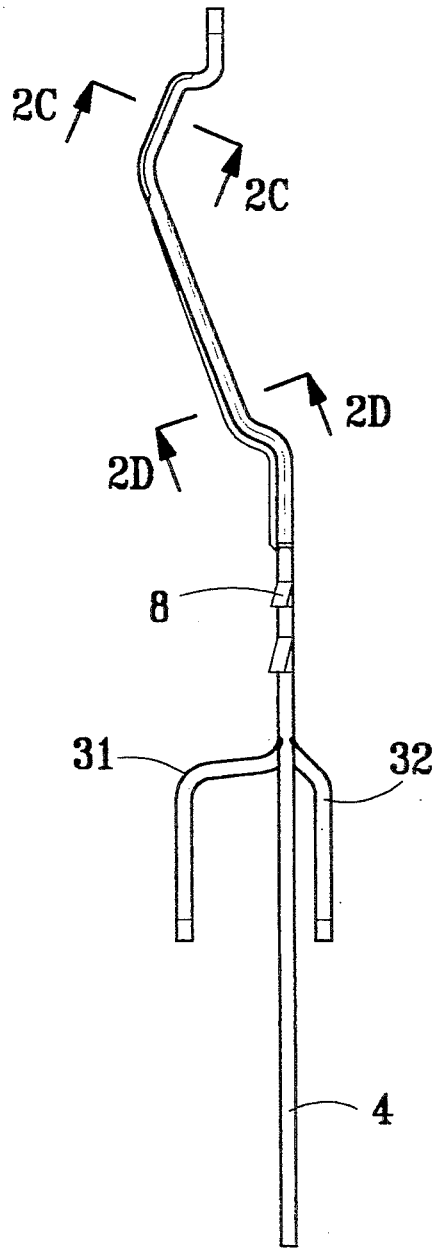
Figure 2C:
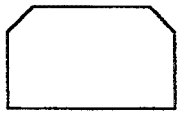
Figure 2D:
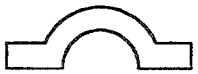
Figure 3A:
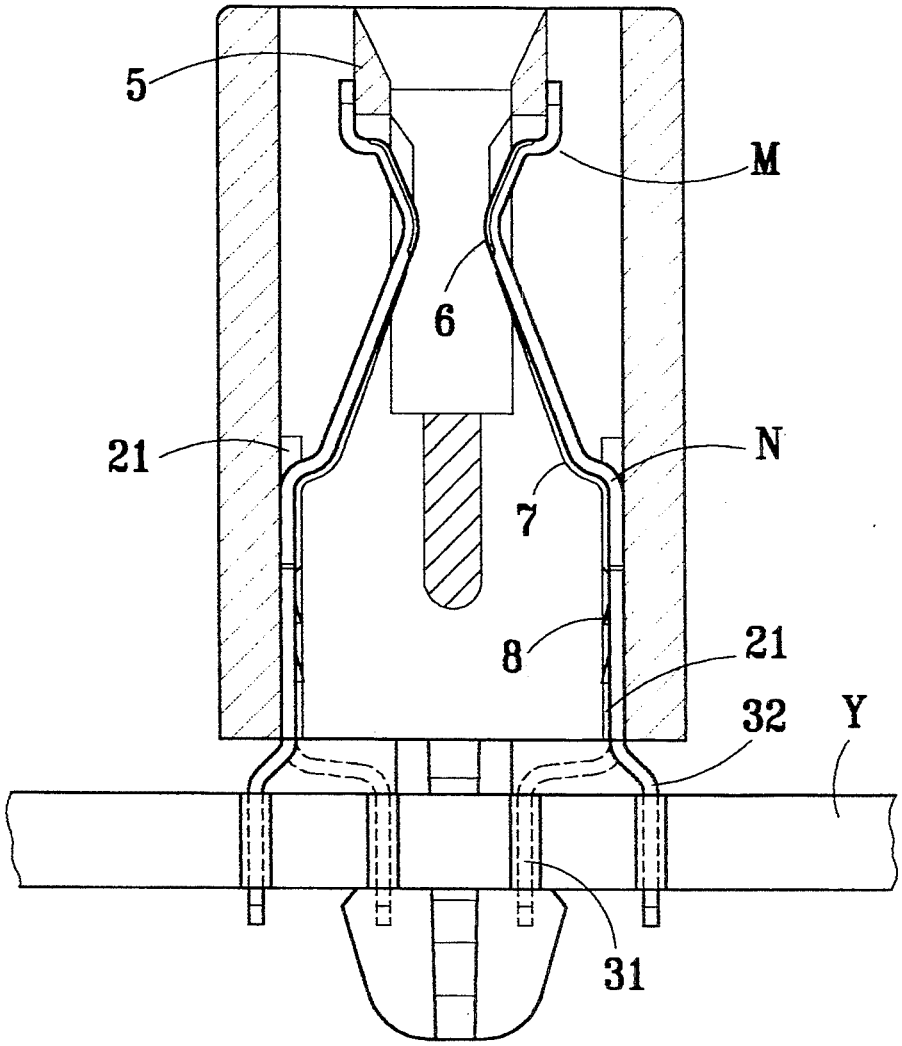
FIGS. 3A and 3B are respectively the side view and the top perspective view showing the conducting plate installed into the connector according to the present invention.
Figure 3B:
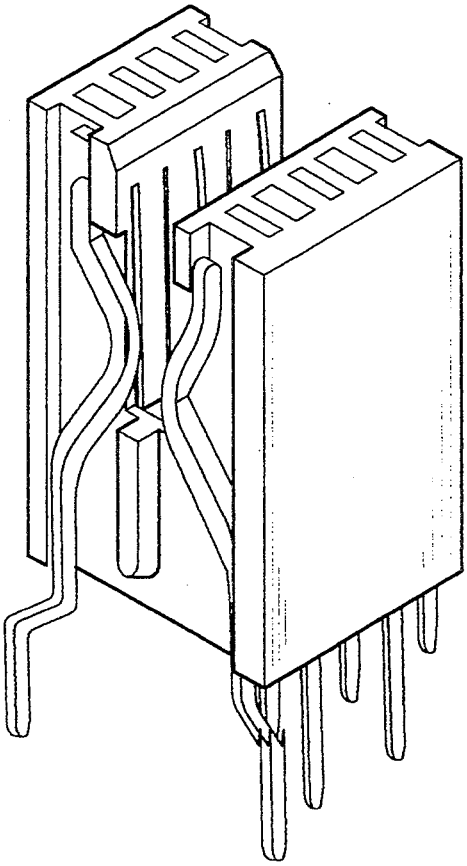

FIG. 2A and 2B shows a band of the conducting plates 3 before the insertion from the bottom of the shell body 1. It is shown in FIG. 2A that a plurality of long contact pins 31 and a plurality of short contact pins 32 of the conducting plates 3 are arranged in an alternate fashion in a band 4. The band 4 with the contact pins can then be inserted from the bottom of the shell body 1 into the insertion channel 21 in a single operation, as shown in FIG. 3A. The conducting plates in the band 4 are then separated through mechanical means in the longitudinal direction of the shell body 1. The overall view of a conducting plate 3 and its appearance after thee insertion into the shell body 1 can be shown in FIGS. 3A and 3B. The top of the two conducting plates are respectively pushing against an inner wall 5 at the top surface of the slots. Each of the conducting plates has a curved corner M below the inner wall and a curved corner N at the inner wall of the insertion channel 21. Below the contact point 6 of the conducting plate 3 is a projected portion 7 which is used to reinforce the conducting plate and is extended beyond the curved corner N. This reinforcement allows the conducting plate to withstand higher impact and pressure. Below the curved corner N is a plurality of protruded member 8 for securing the conducting plate.

Figure 4A:
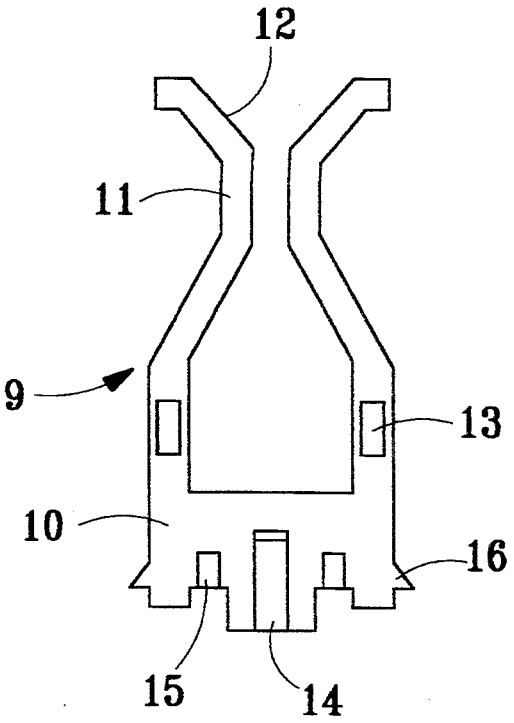
FIGS. 4A and 4B respectively show a front view and a side view of the printed circuit board securing member according to the present invention.
Figure 4B:
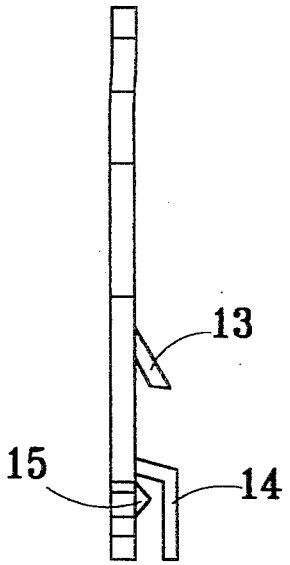

The printed circuit board is secured by a securing member 9 which reinforces the conducting plate 3, as is shown in FIGS. 4A and 4B. The shape of the printed circuit board securing member 9 is symmetrical from left to right. This symmetry includes a base 10 and two curved arms 11 which extend upward from the base 10 in parallel and bend toward each other at an appropriate location before diverting from each other again. A slope edge 12 is formed at the end of each curve arm 11 which is used to guide the insertion of the printed circuit board. Each of the paralleled portions of the curved arms has a resilient clip 13 which slopes downward. The center of the base 10 has a blocking member 14, which is bent and each side of which has a first projected portion 15. The two resilient clip 13, the blocking member 14 and the two projected portions 15 all protrude beyond the surface of the printed circuit board securing member. The two ends of the base have second projected portions 16, which maintain a flat surface with the securing member 9.

Figure 7:
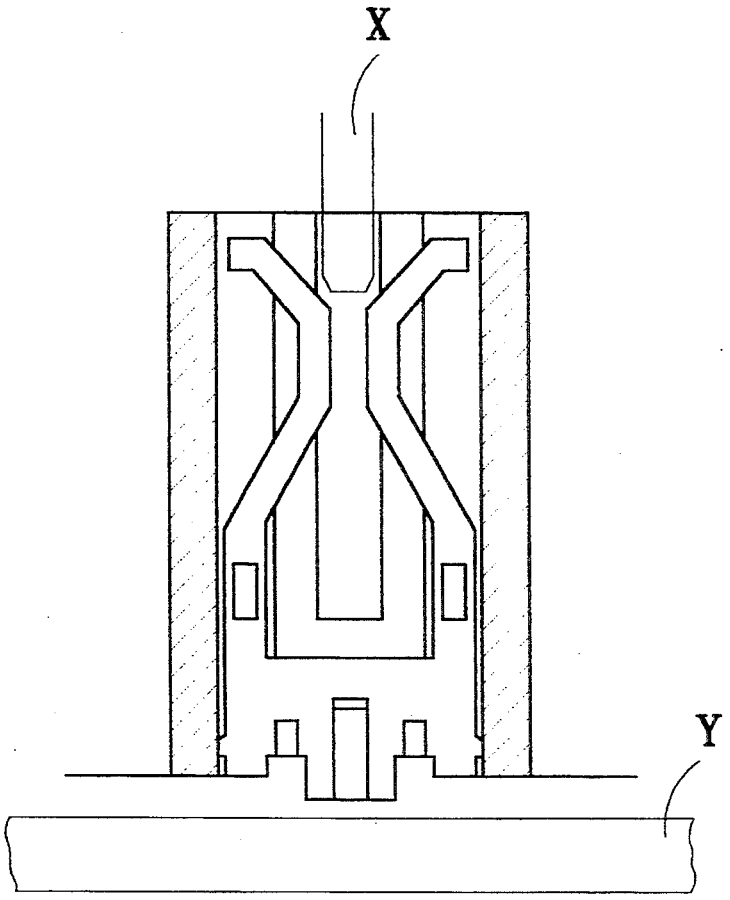
FIG. 7 shows an embodiment of the printed circuit board securing member installed in the connector according to the present invention.
Figure 10:
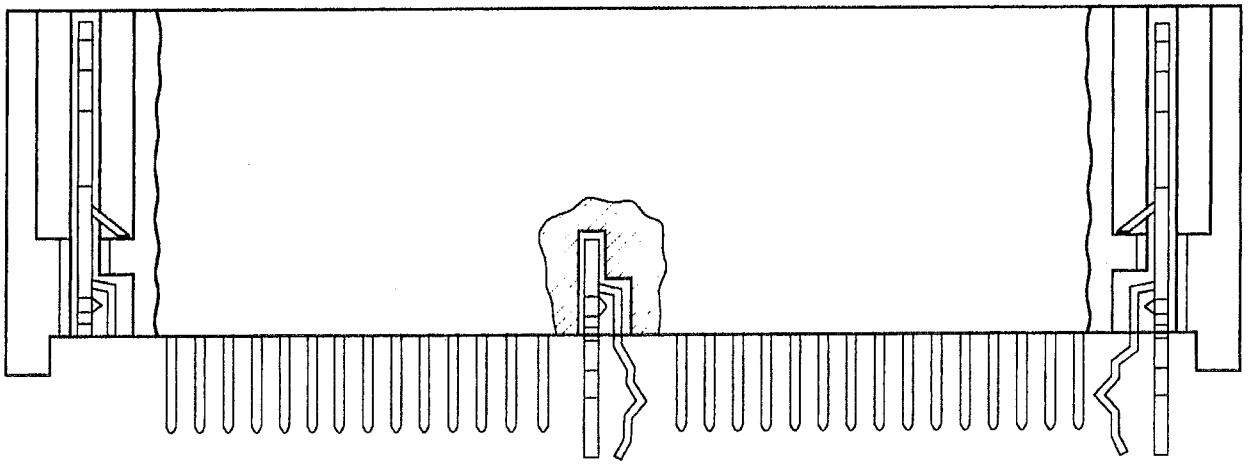
FIG. 10 shows an embodiment of the three aforesaid securing members installed in the connector according to the present invention.

FIG. 7 shows an installed securing member 9 in the shell body 1. It is a side view looking into the 'a' portion in FIG. 1. The 'a' portion of FIG. 10 is a side view illustrating the securing member 9 installed in the shell body 1. It is shown in these two figures that the printed circuit board securing member 9 is prevented from sliding downward through the use of resilient clip 13 when a printed circuit board is pushed down to insert. The blocking member 14 is used to block the securing member from being pulled up when the printed circuit board is being removed from the slot. Therefore, the projected portions 15 and 16 are designed to prevent the up and down movement of the securing member 9 due to the insertion and removal of the printed circuit board.

Figure 5A:
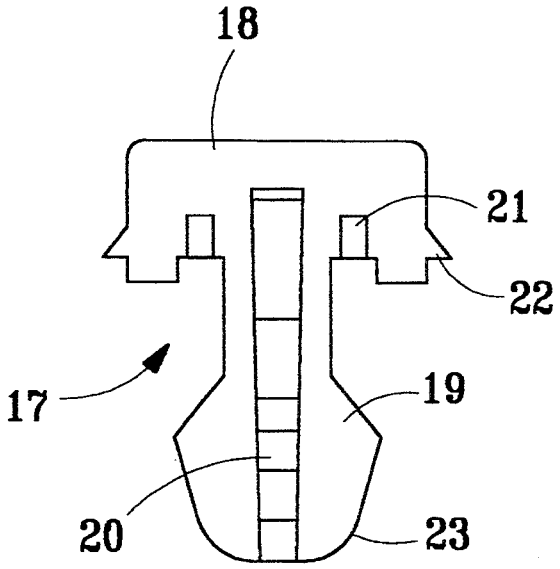
FIGS. 5A, 5B and 5C respectively show a front view, a side view and a perspective view of the mother board securing member according to the present invention.
Figure 5B:
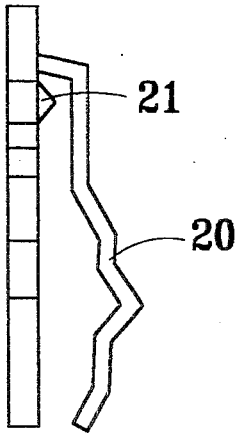
Figure 5C:
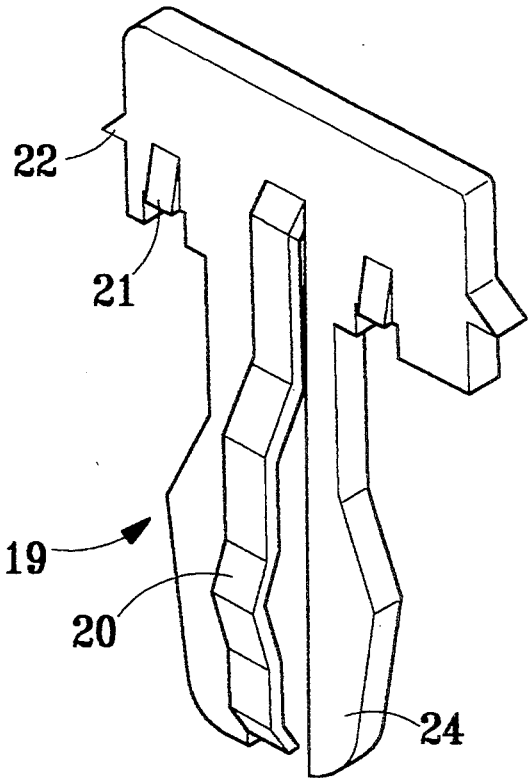

A mother board securing member 17 is used to securely mount the connector into the mother board, as is shown in FIGS. 5A and 5B, which are the front view and the side view of the securing member 17. It is also symmetrical from left to right, including a base 18, a leg portion 19 which extends downward from the center of the base 18, and a bent portion 20 which extends downward from the upper central portion of the leg portion 19. In the two edges of the center leg portion 19 are first projected member 21, the borders of the base 18 have second projected portion 22. The width at the end of the leg portion 19 is widen, and a guiding arc 23 is formed at the end to allow it to feed through the holes of the mother board. The leg portion 19 forms a pair of symmetrical but separated sub-legs 24 because of the design structure of the bent portion 20, as is shown in FIG. 5C.

Figure 8:
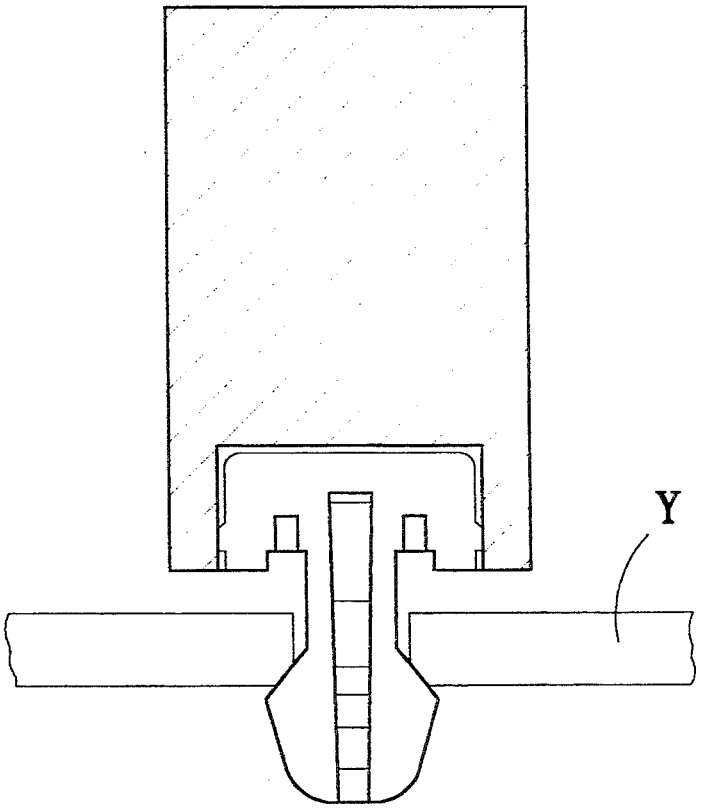
FIG. 8 shows an embodiment of the mother board securing member installed in the connector according to the present invention.

FIG. 8 shows an embodiment of the mother board securing member 17 installed in the shell of the connector body. It is a side view looking into the 'b' section in FIG. 1. The 'b' portion of FIG. 10 is a side view of the mother board securing member installed in the shell body. It is shown from these two figures that the compressed condition between the shell body and the projected portion 21 and 22 allows the mother board securing member to be firmly mounted inside the shell body. The mother board securing member uses the two sub-legs 24 and the bent portion 20 to feed through the corresponding holes arranged in the mother board and securely mounted on the mother board.

Figure 6A:
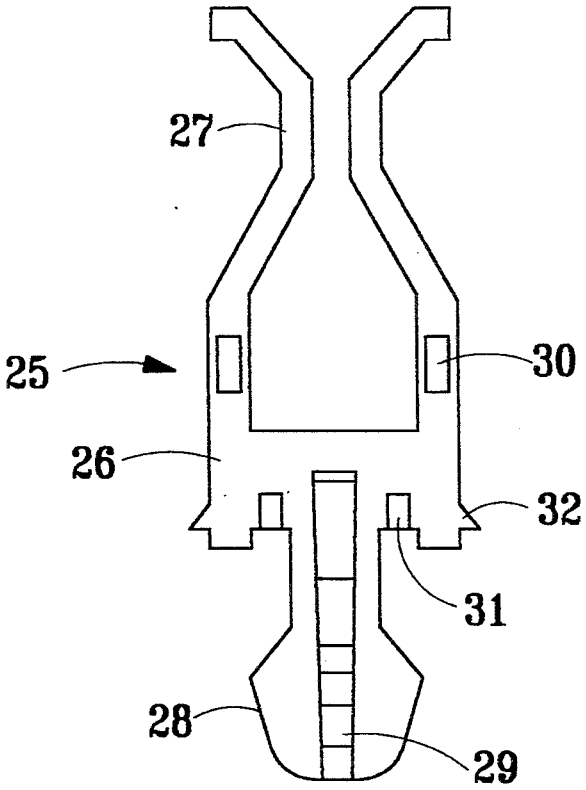
FIGS. 6A and 6B are respectively the front view and the side view of the dual-usage securing member according to the present invention.
Figure 6B:
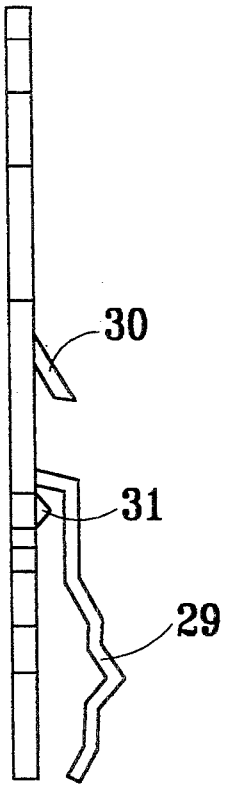

FIGS. 6A and 6B shows a dual-usage securing member 25 which functions to secure the mother board as well as the inserted printed circuit board. Its structure is basically a combination of the two structures of the printed circuit board securing member 9 and the mother board securing member 17. It includes a base 26, two curved arms 27 which extend upward from the base 26, a leg portion 28 which is made up of two sub-legs, a bent portion 29, a resilient clip 30 on the curved arm 27, the first projected portion 31 and the second projected portion 32 which are both located on the base 26.

Figure 9:
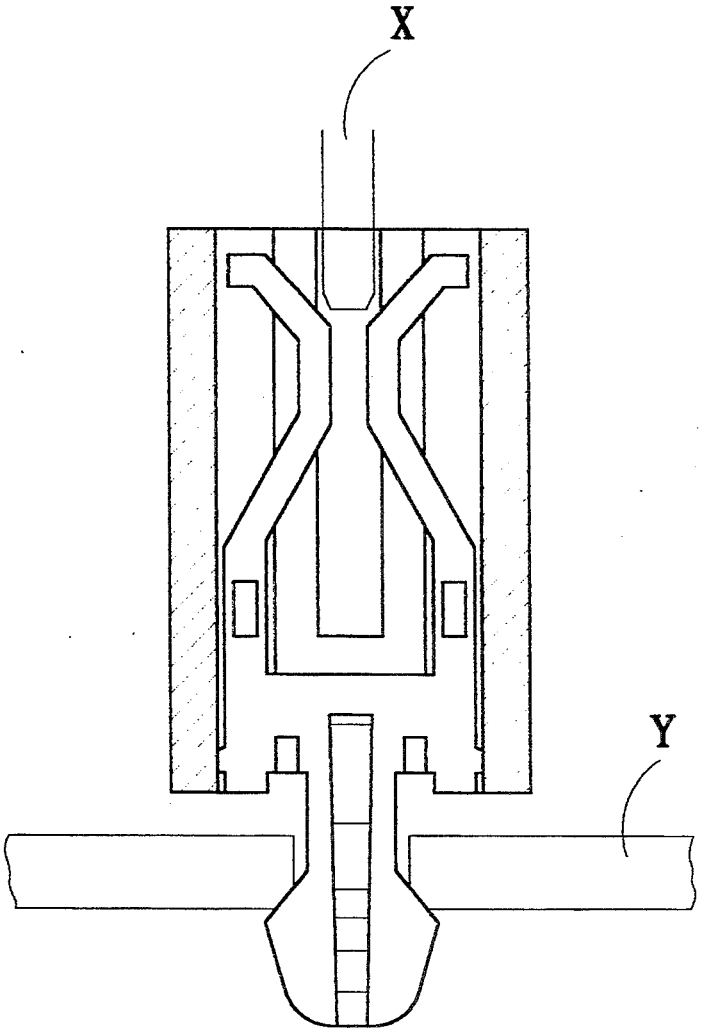
FIG. 9 shows an embodiment of the dual-usage securing member installed in the connector according to the present invention.

FIG. 9 shows an embodiment of the dual-usage securing member 25 installed inside the shell body of the connector. It is a view looking into the side of the 'c' section in FIG. 1. The 'c' section in FIG. 10 is a diagrammatic view of the dual-usage securing member installed in the shell body of the connector.

Referring to the arrangement of the three securing members installed in the connector as shown in FIG. 10, the mother board securing member with the bent portion 20 and the dual-usage securing member with the bent portion 29 installed are designed to prevent the connector to shift in the lateral direction. The sub-legs are designed to prevent the connector to migrate in the longitudinal direction.

The connector according to the present invention is designed to use the combination of the three types of the securing members.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

What is claimed is:

1. A printed circuit board slot connector comprising:

an elongated shell body having at least one slot opening in its longitudinal direction, said slot opening being used for the insertion of a printed circuit board, vertical side walls of the slot having a row of channels, each of which has a conducting plate, which extends through the bottom of the shell body, the conducting plates being used to provide electrical contacts between the inserted printed circuit board and the mother board, the conducting plate comprising;

a top portion which pushes against an inner wall at the top surface of the slots, below that surface of the inner wall is a first curved corner;

an angled curved corner which slopes downward from the first curved corner an is used to provide electrical contact for the inserted printed circuit board;

an extension portion which slopes down ward from the angled curved corner to the bottom of the shell body, a second curved corner is formed between the insertion channel and a contact at the inner wall; and a plurality of long or short contact pins which extend from the extension portion and feed through the bottom of the insertion channel;

wherein a projected portion is formed in a location between the bottom of the angled curved corner and the bottom of the second curved corner, said projected portion is used to reinforce the conducting plate, extending beyond the second curved corner is a plurality of protruded members for securing the conducting plate, wherein a symmetrical mother board securing member is installed in the shell body, said mother board securing member comprises:

a base; and a leg portion which extends downward from the center of said base, has a bent portion which protrudes and extends downward from the upper central portion of the leg portion, and a pair of symmetrical but separated sub-legs formed from the structure of the bent portion protruding from the leg portion, the width towards an end of the sub-legs widens gradually and a guiding arc is formed at the end to allow said leg portion to feed through the holes of the mother board;

wherein the two edges of the leg portion have first projected members, the borders of the base also have second projected portions on each side, the two first projected portions and the bent portion protrude above the surface of the mother board securing member, the two second projected portions are leveled with the surface of the mother board securing member.

2. A printed circuit board slot connector as recited in claim 1 wherein at least one printed circuit board securing member is installed inside the shell body of the connector, said securing member for the inserted printed circuit board is symmetrical and comprises:

a base, the center of which has a bent blocking member, each side of the blocking member has a first projected portion, the two ends of the base have second projected portions; and two curved arms, which extend upward from the base in parallel and bend toward each other before bending away from each other again, a slope edge is formed at the end of each of the curved arms which is used to guide the insertion of the printed circuit board, each of the paralleled portions of the curved arms has a resilient clip which slopes downward;

wherein said resilient clip, the blocking member and the two first projected portions all protrude above the surface of the printed circuit board securing member, the two second projected portions maintain a flat surface with the inserted printed circuit board securing member.

3. A printed circuit board slot connector as recited in claim 1 wherein at least one symmetrical dual-usage securing member is installed in the shell body of the connector, said dual-usage securing member is used to secure the position of the mother board and the inserted printed circuit board, it comprises:

a base;

two curved arms, which extend upward from the base in parallel and bend toward each other at an appropriate location before diverting from each other again, a slope edge is formed at the end of each of the curved arms which is used to guide the insertion of the printed circuit board, each of the parallel portions of the curved arms has a resilient clip which slopes downward;

a leg portion, which extends downward from the center of said base, has a bent portion which protrudes and extends downward from the upper central portion of the leg portion, and a pair of symmetrical but separated sub-legs formed from the structure of the bent portion protruding from the leg portion, the width towards an end of the sub-legs widens gradually and a guiding arc is formed at the end to allow said leg portion to feed through the holes of the mother board;

wherein the two edges of the leg portion have first projected members, the borders of the base also have second projected portions, the two first projected portions and the bent portion protrude above the surface of the dual-usage securing member, the second projected portions being level with the dual-usage securing member.

4. A printed circuit board slot connector comprising:

an elongated shell body having at least one slot opening in its longitudinal direction, said slot opening being used for the insertion of a printed circuit board, vertical side walls of the slot having a row of channels, each of which has a conducting plate, which extends through the bottom of the shell body, the conducting plates being used to provide electrical contacts between the inserted printed circuit board and the mother board, the conducting plate comprising;

a top portion which pushes against an inner wall at the top surface of the slots, below that surface of the inner wall is a first curved corner;

an angled curved corner which slopes downward from the first curved corner an is used to provide electrical contact for the inserted printed circuit boards;

an extension portion which slopes down ward from the angled curved corner to the bottom of the shell body, a second curved corner is formed between the insertion channel and a contact at the inner wall; and a plurality of long or short contact pins which extend from the extension portion and feed through the bottom of the insertion channel;

wherein a projected portion is formed in a location between the bottom of the angled curved corner and the bottom of the second curved corner, said projected portion is used to reinforce the conducting plate, extending beyond the second curved corner is a plurality of protruded members for securing the conducting plate, wherein a printed circuit board securing member is installed inside the shell body of the connector, said securing member is symmetrical and comprises:

a base, the center of which has a bent blocking member, each side of the blocking member has a first projected portion, the two ends of the base have second projected portions; and two curved arms which extend upward from the base in parallel and bend toward each other before bending away from each other again, a slope edge is formed at the end of each of the curved arms which is used to guide the insertion of the printed circuit board, each of the parallel portions of the curved arms in the periphery of the base has a resilient clip which slopes downward;

wherein said resilient clip, the blocking member and the two first projected portions all protrude above the surface of the printed circuit board securing member, the second projected portions maintain a flat surface with the surface of the securing member.

5. A printed circuit board slot connector comprising:

an elongated shell body having at least one slot opening in its longitudinal direction, said slot opening being used for the insertion of a printed circuit board, vertical side walls of the slot having a row of channels, each of which has a conducting plate, which extends through the bottom of the shell body, the conducting plates being used to provide electrical contacts between the inserted printed circuit board and the mother board, the conducting plate comprising;

a top portion which pushes against an inner wall at the top surface of the slots, below that surface of the inner wall is a first curved corner;

an angled curved corner which slopes downward from the first curved corner an is used to provide electrical contact for the inserted printed circuit board;

an extension portion which slopes down ward from the angled curved corner to the bottom of the shell body, a second curved corner is formed between the insertion channel and a contact at the inner wall; and a plurality of long or short contact pins which extend from the extension portion and feed through the bottom of the insertion channel;

wherein a projected portion is formed in a location between the bottom of the angled curved corner and the bottom of the second curved corner, said projected portion is used to reinforce the conducting plate, extending beyond the second curved corner is a plurality of protruded members for securing the conducting plate, wherein at least one symmetrical dual-usage securing member is installed in the shell body of the connector, said dual-usage securing member is used to secure the portion of the mother board and the inserted printed circuit board, it comprises:

a base;

two curved arms which extend upward from the base in parallel and bend toward each other before bending away from each other again, a slope edge is formed at the end of each of the curved arms which is used to guide the insertion of the printed circuit board, each of the parallel portions of the curved arms in the periphery of the base has a resilient clip which slopes downward;

a leg portion which extends downward form the center of said base, has a bent portion which protrudes and extends downward from the upper central portion of the leg portion, and a pair of symmetrical but separated sub-legs formed from the structure of the bent portion protruding from the leg portion, the width towards an end of the sub-legs widens gradually and a guiding arc is formed at the end to allow said leg portion to feed through the holes of the mother board;

wherein the two edges of the leg portion have first projected members, the borders of the base also have second projected portions, said resilient clip, the two first projected portions and the bent portion all protrude above the surface of the dual-usage securing member, the second projected portions being level with the dual-usage securing member.

6. A printed circuit board slot connector comprising an elongated shell body having at least one slot opening in its longitudinal direction, said slot opening is used for the insertion of a printed circuit board, vertical side walls of the slot have a row of channels, each of which has a conducting plate which extends through the bottom of the shell body, said conducting plates are used to provide electrical contact between the inserted printed circuit board and the mother board, the improved structure of the connector has at least one dual-usage securing member which is used to secure the inserted printed circuit board and the mother board simultaneously, said securing member is located in an appropriate location of the shell body and comprises:

a base;

two curved arms, which extend upward from the base in parallel and bend toward each other at an appropriate location before diverting from each other again, a slope edge is formed at the end of each of the curve arms which is used to guide the insertion of the printed circuit board, each of the paralleled portions of the curved arms has a resilient clip which slopes downward;

a leg portion, which extends downward from the center of said base, has a bent portion which protrudes and extends downward from the upper central portion of the leg portion, and a pair of symmetrical but separated sub-legs formed from the structure of the bent portion protruding from the leg portion, the width towards the end of the sub-legs widens gradually and a guiding arc is formed at the end to allow said leg portion to feed through the holes of the mother board;

wherein the two edges of the leg portion have first projected member, the borders of the base also have second projected portions, also said resilient clip, the two first projected portions and the bent portion all protrude above the surface of the dual-usage securing member, the second projected portions is level with the dual-usage securing member.

7. A printed circuit board slot connector as recited in claim 6 wherein said connector comprises two pieces of dual-usage securing member which are installed face to face to each other.

* * * * *